US011807820B2

(12) United States Patent
Rooney et al.

(10) Patent No.: US 11,807,820 B2
(45) Date of Patent: Nov. 7, 2023

(54) PROCESSES FOR ON-STREAM DECOKING

(71) Applicant: ExxonMobil Chemical Patents Inc., Baytown, TX (US)

(72) Inventors: Mark A. Rooney, Pasadena, TX (US); Christopher Dillard, Baton Rouge, LA (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 30 days.

(21) Appl. No.: 17/431,189

(22) PCT Filed: Mar. 19, 2020

(86) PCT No.: PCT/US2020/023737
§ 371 (c)(1),
(2) Date: Aug. 16, 2021

(87) PCT Pub. No.: WO2020/191253
PCT Pub. Date: Sep. 24, 2020

(65) Prior Publication Data

US 2022/0154083 A1 May 19, 2022

Related U.S. Application Data

(60) Provisional application No. 62/821,133, filed on Mar. 20, 2019.

(30) Foreign Application Priority Data

Jul. 23, 2019 (EP) ..... 19187733

(51) Int. Cl.
*C10G 9/16* (2006.01)
*C10G 9/20* (2006.01)

(52) U.S. Cl.
CPC ..... *C10G 9/16* (2013.01); *C10G 9/20* (2013.01); *C10G 9/206* (2013.01)

(58) Field of Classification Search
CPC ..... C10G 9/16; C10G 9/20; C10G 9/206
See application file for complete search history.

(56) References Cited

U.S. PATENT DOCUMENTS 3,365,387 A 1/1968 Cahn et al.
5,283,049 A * 2/1994 Fluder ..... C01B 3/24 165/95

(Continued)

FOREIGN PATENT DOCUMENTS

CN 101372630 2/2009

*Primary Examiner* — Renee Robinson

(57) ABSTRACT

In some examples, a flow of hydrocarbon feed can be introduced into a pyrolysis furnace that includes a first radiant coil and a second radiant coil. At least a portion of the hydrocarbon feed can be pyrolysed in the first radiant coil and the second radiant coil to produce a pyrolysis effluent and to deposit coke on an inner surface of each of the first radiant coil and the second radiant coil. The flow of the hydrocarbon feed can be decreased into the first radiant coil and the flow of the hydrocarbon feed into the second radiant coil can be maintained, wherein the flow of the hydrocarbon feed into the pyrolysis furnace can be decreased by about 10 vol. % to about 90 vol. %. A decoking feed including steam at a pressure of ≥690 kPag can be introduced into the first radiant coil of the pyrolysis furnace to remove at least a portion of the coke deposited on the inner surface of the first radiant coil.

31 Claims, 3 Drawing Sheets

(56) References Cited

U.S. PATENT DOCUMENTS

| | | | |
|---|---|---|---|
| 5,656,150 | A | 8/1997 | Reed et al. |
| 6,228,253 | B1 | 5/2001 | Gandman |
| 7,625,480 | B2 | 12/2009 | Beattie et al. |
| 8,864,977 | B2 | 10/2014 | Spicer |
| 2007/0232845 | A1 | 10/2007 | Baumgartner et al. |
| 2014/0060586 | A1 | 3/2014 | Hill |

* cited by examiner

PROCESSES FOR ON-STREAM DECOKING

CROSS-REFERENCE TO RELATED APPLICATIONS

This application is a US national phase application of PCT Application Serial No. PCT/US2020/023737 having a filing date of Mar. 19, 2020, which claims priority to and the benefit of U.S. Provisional Application No. 62/821,133 having a filing date of Mar. 20, 2019 and European Patent Application No. 19187733.1having a filing date of Jul. 23, 2019, the disclosures of all of which are incorporated herein by reference in their entireties.

Embodiments disclosed herein generally relate to thermal cracking of hydrocarbons for the production of olefins, particularly low molecular weight olefins such as ethylene. More particularly, such embodiments relate to the removal of coke deposits that form during such thermal cracking process.

BACKGROUND

Coke is an undesirable byproduct of steam cracking, which forms on internal coil surfaces of the steam cracking furnace, e.g., on the radiant coils' internal surfaces. The presence of coke lessens heat transfer to the heated feedstock and steam mixture in the radiant coils, which results in less than the desired amount of thermal cracking. The presence of coke can also lead to undesirable changes in radiant coil composition, e.g., as a result of carburization, leading to radiant coil deterioration. Accordingly, it is desirable to remove coke from one or more of the furnace coils during periodic "decoking" modes, during which at least some of the furnace's coils (e.g., all the furnace's radiant coils) are designated for decoking.

Within the industry the normal method for removing coke from the radiant and quench systems of a cracking furnace is steam-air-decoking. During this process the hydrocarbon feed is interrupted to the furnace and steam passes through the furnace to remove any residual hydrocarbon feed therefrom. The furnace effluent is redirected from the recovery section of the olefins plant to a decoking system. Air is added to the steam passing through the furnace and the heated air/steam mixture removes the coke deposits by controlled combustion. While steam-air-decoking is effective at removing coke deposits from the radiant coil and quench systems of cracking furnaces, it has the drawback of requiring a complete cessation of olefins production from the furnace for the duration of the decoking process.

The prior attempts to develop on-stream decoking processes also have significant drawbacks. If the decoking stream is steam alone, then the temperature leaving the convection section and entering the radiant section of the furnace (known as the crossover temperature) can exceed the capacity of the materials commonly used to construct this section of the furnace. To keep the crossover temperature within the capacity of commonly used materials, it has been necessary to either add water to the steam or to use low-pressure steam. Both the use of water and low-pressure steam are undesired because they reduce operator flexibility making it more difficult to respond during decoking operations.

There is a need, therefore, for improved processes for the on-stream decoking of a pyrolysis furnace.

SUMMARY

Processes for on-stream de-coking are provided. In some examples, the process can include a hydrocarbon pyrolysis process. A flow of hydrocarbon feed can be introduced into a pyrolysis furnace including a first radiant coil and a second radiant coil. At least a portion of the hydrocarbon feed can be pyrolysed in the first radiant coil and the second radiant coil to produce a pyrolysis effluent and to deposit coke on an inner surface of each of the first radiant coil and the second radiant coil. The flow of the hydrocarbon feed can be decreased into the first radiant coil and the flow of the hydrocarbon feed into the second radiant coil can be maintained, wherein the flow of the hydrocarbon feed into the pyrolysis furnace can be decreased by about 10 vol. % to about 90 vol. %. A decoking feed including steam at a pressure of ≥690 kPag, particularly ≥930 kPag, can be introduced into the first radiant coil of the pyrolysis furnace to remove at least a portion of the coke deposited on the inner surface of the first radiant coil.

In some examples, a flow of hydrocarbon feed can be introduced into a pyrolysis furnace including a first radiant coil and a second radiant coil. At least a portion of the hydrocarbon feed can be pyrolysed in the first radiant coil and the second radiant coil to produce a pyrolysis effluent and to deposit coke on an inner surface of each of the first radiant coil and the second radiant coil. The flow of the hydrocarbon feed can be decreased into the first radiant coil and the flow of the hydrocarbon feed into the second radiant coil can be maintained, wherein the flow of the hydrocarbon feed into the pyrolysis furnace can be decreased by about 10 vol. % to about 90 vol. %. A decoking feed including steam at a pressure of ≥690 kPag, particularly ≥930 kPag, can be introduced into the first radiant coil of the pyrolysis furnace to remove at least a portion of the coke deposited on the inner surface of the first radiant coil. An automated system can be used to adjust the firing rate of the pyrolysis furnace to maintain a crossover temperature of the pyrolysis furnace at or below a target temperature of the pyrolysis furnace.

In some examples, a flow of a hydrocarbon feed can be introduced into at least one radiant coil of a pyrolysis furnace. At least a portion of the hydrocarbon feed can be pyrolysed in the at least one radiant coil to produce a pyrolysis effluent and to deposit coke on an inner surface of the at least one radiant coil. The flow of the hydrocarbon feed can be decreased into the at least one radiant coil, and a flow of a decoking feed including steam at a pressure of ≥690 kPag can be introduced into the at least one radiant coil of the pyrolysis furnace to remove at least a portion of the coke deposited on the inner surface of the at least one radiant coil.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
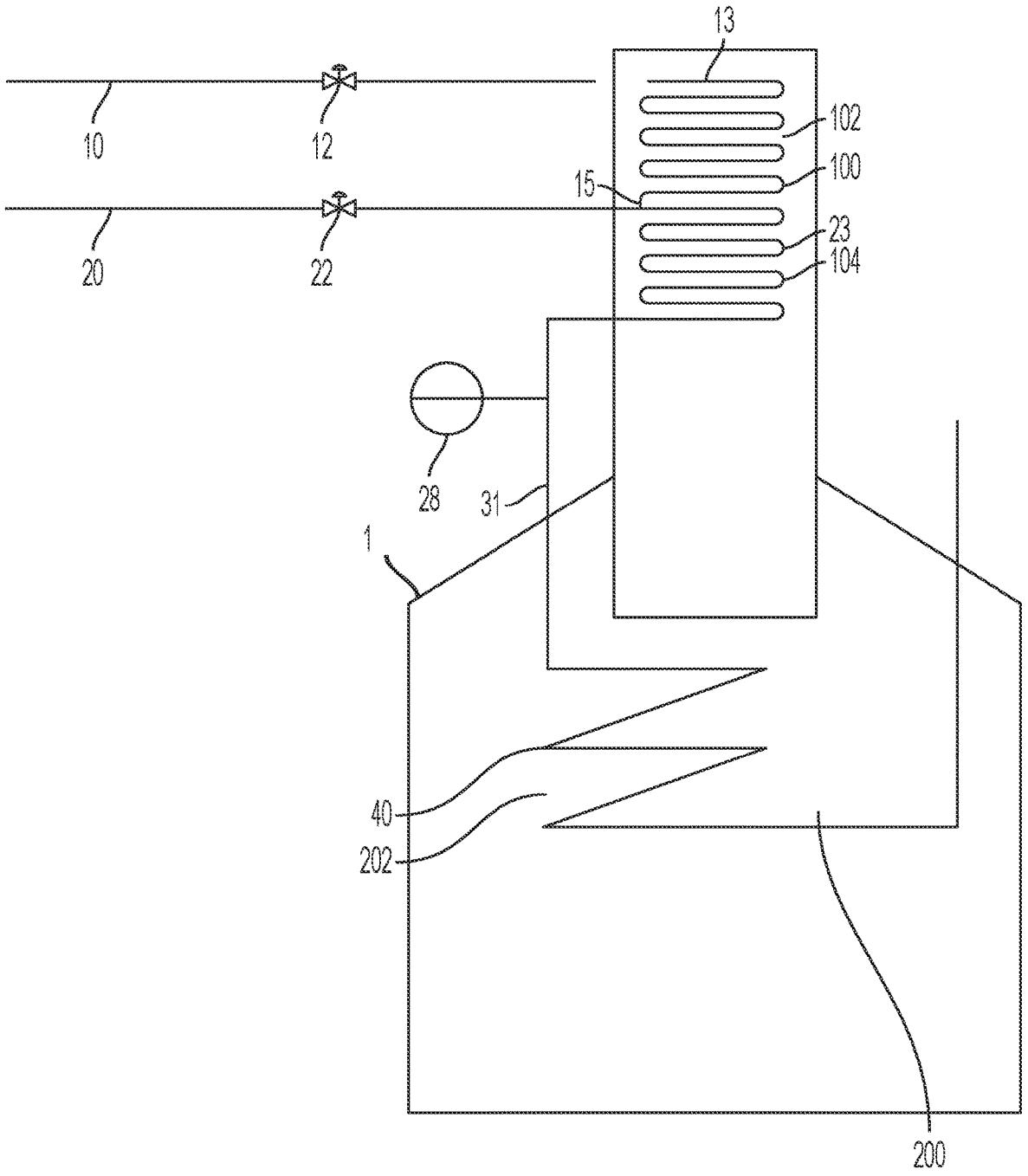
FIG. 1 is a schematic flow diagram of a process for on-stream de-coking in a steam cracker, according to one or more embodiments described.

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the exemplary embodiments presented below can be combined in any combination of ways, i.e., any element from one exemplary embodiment can be used in any other exemplary embodiment, without departing from the scope of the disclosure.

Definitions

"Hydrocarbon feed" means any feed that includes hydrocarbon and is suitable for producing $C_{2+}$ unsaturated hydrocarbon by pyrolysis, such as by steam cracking. Typical hydrocarbon feeds include ≥10% hydrocarbon (weight basis, based on the weight of the hydrocarbon feed), e.g., ≥50%, such as ≥90%, or ≥95%, or ≥99%.

In some examples, a flow of a hydrocarbon feed can be pyrolysed in a steam cracking or pyrolysis furnace to produce a pyrolysis effluent and to produce coke. A portion of the produced coke can be removed by decreasing the flow of the hydrocarbon feed and introducing a decoking feed comprising steam at a pressure of ≥690 kPag, particularly ≥930 kPag.

It has been surprisingly and unexpectedly discovered that the use of a decoking feed comprising steam at a pressure of ≥690 kPag, particularly ≥930 kPag, allows for greater operator flexibility by allowing decoking, including multiple simultaneous decoking, to occur without exceeding the maximum crossover temperature of the steam cracking furnace 1. Utilizing steam at a pressure of ≥690 kPag, particularly ≥930 kPag, also provides an appreciable improvement in crossover temperature control. The improved control decreases crossover temperature excursions that would otherwise occur when using conventional temperature control technology, which in turn leads to a decrease in light olefin production. It is observed that the conventional method of crossover temperature control (increasing or decreasing steam cracker furnace burner duty) by itself results in an undesirable production loss of light olefin because a significant change in burner duty is needed to effect a relatively small change in crossover temperature. Providing steam at a pressure of ≥690 kPag, particularly ≥930 kPag, allows an operator to regulate crossover temperature with a lesser range of burner duty variation (and thus a lesser amount of light olefin production loss in response to a decrease in burner duty).

FIG. 1 is a schematic flow diagram of a process for on-stream de-coking in a steam cracking or pyrolysis furnace 1, according to one or more embodiments. The hydrocarbon feed contains a significant quantity of non-volatile material. In some examples, the steam cracking furnace 1 can include those disclosed in U.S. Pat. No. 7,138,047 and U.S. Patent Publication No. 2005/0209495 A1. The steam cracking furnace 1 can include a convection section 100 and a radiant section 200. Fuel gas can be provided via a conduit and control valve to burners that provide radiant heat to a hydrocarbon feed to produce the desired pyrolysis effluent by thermal cracking of the feed. The burners can generate hot gas that flows through the convection section 100 and then away from the furnace via a conduit.

Hydrocarbon feed can be conducted via conduit 10 and valve 12 to a first bank of convection coils. Hydrocarbon feed introduced into convection coil 13 can be preheated by indirect contact with hot flue gas. Valve 12 can be used to regulate the amount of hydrocarbon feed introduced into one or more convection coils 13. Convection coil 13 can be one of a plurality of convection coils that are arranged in a first coil bank for parallel hydrocarbon feed flow. A plurality of feed conduits (not shown) can convey hydrocarbon feed to each of the parallel convection coils (not shown) in the first tube bank 102. One feed conduit is represented in FIG. 1, but the process is not limited to any particular number of feed conduits. For example, the process can be compatible with convection sections having 3, 4, 6, 8, 10, 12, 16, or 18 feed conduits for conveying in parallel equal or unequal portions of a total hydrocarbon feed to an equivalent number of convection coils located in the first coil bank. Although not shown, each of the plurality of feed conduits can be provided with a valve (similar to valve 12). In other words, each of the plurality of conduits can be in fluid communication with a convection coil (not shown) operating in parallel with convection coil 13. For simplicity, the description of the first convection coil bank 102 will focus on coil 13. The other convection coils in the bank can operate in a similar manner.

Dilution steam can be provided via dilution steam conduit 20 through valve 22 to convection coil 23 for preheating by indirect transfer of heat from flue gas. Valve 22 can be used to regulate the amount of dilution steam introduced into the one or more convection coils 23. The preheated hydrocarbon feed can be mixed, blended, or otherwise combined with the dilution steam from conduit 20 in or proximate to mix point 15 and the hydrocarbon+steam mixture can be preheated in convection coil 23. Convection coil 23 can be one of a plurality of convection coils that are arranged in a second coil bank for parallel dilution steam flow. A plurality of dilution steam conduits (not shown) can convey dilution steam to each of the parallel convection coils of the second tube bank 104. One dilution steam conduit is represented in FIG. 1, but the process is not limited to any particular number of dilution steam conduits. For example, the process can be compatible with convection sections having 3, 4, 6, 8, 10, 12, 16, or 18 dilution steam conduits for conveying in parallel portions of an amount of total dilution steam to an equivalent number of convection coils located in the second convection coil bank 104. Although not shown, each of the plurality of dilution steam conduits can be provided with a valve (similar to valve 22). In other words, each of the plurality of conduits can be in fluid communication with a convection coil (not shown) operating in parallel with convection coil 23. For simplicity, the description of the second convection coil bank 104 will focus on coil 23. The other convection coils in the bank can operate in a similar manner. The hydrocarbon+steam mixture can be preheated in convection coil 23, e.g., to a temperature of about 400° C. to about 760° C.

Alternatively, the dilution steam and the hydrocarbon feed can be both preheated in separate convection coils prior to being mixed together. The preheated dilution steam and preheated hydrocarbon feed can be mixed, blended, or otherwise combined. The hydrocarbon+steam mixture can be reintroduced into convection section via conduit(s), for preheating of the hydrocarbon+steam mixture in a convection coil of a third convection section tube bank. This convection coil can be one of a plurality of convection coils that can be arranged in the third tube bank for parallel flow of the hydrocarbon+steam mixture. The process is not limited to any particular number of these convection coils. For example, the process is compatible with a third coil bank having 3, 4, 6, 8, 10, 12, 16, or 18 convection coils for conveying in parallel portions of an amount of total hydrocarbon+steam mixture. The other convection coils in the bank can operate in a similar manner. The hydrocarbon+steam mixture can be preheated in these convection coils to a temperature of about 400° C. to about 760° C.

Cross-over piping 31 can be used to convey the preheated hydrocarbon+steam mixture to radiant coil 40 in radiant section 200 where the hydrocarbon can be thermally cracked. The crossover temperature can be measured using temperature gauge 28. Radiant coil 40 can be one of a plurality of radiant coils (the others are not shown), which together can constitute a bank of radiant coils 202 in radiant section 200. The temperature of the heated mixture entering conduit 31 can be at or near the temperature at which significant thermal cracking commences. Process conditions such as the amount of feed pre-heating in convection coil 13, the amount of hydrocarbon+steam mixture pre-heating in convection coil 23, the relative amount of hydrocarbon feed and dilution steam, the temperature, pressure, and residence time of the preheated hydrocarbon+steam mixture in radiant coil 40, and the duration of the first time interval (the duration of pyrolysis mode in coils 13, 23, and 40) typically depend on the composition of the hydrocarbon feed, yields of desired products, and the amount of coke accumulation in the furnace (particularly in radiant coils) that can be tolerated. Certain hydrocarbon feeds and process conditions used for steam cracking those feeds will now be described in more detail. The invention is not limited to these feeds and process conditions, and this description is not meant to foreclose other feeds and/or process conditions within the broader scope of the invention.

Hydrocarbon Feeds

In certain aspects, the hydrocarbon feed can be or include, but is not limited to, relatively high molecular weight hydrocarbons ("Heavy Feedstocks"), such as those that produce a relatively large amount of steam cracker tar ("SCT") during steam cracking. Examples of Heavy Feedstocks include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, crude oil, atmospheric pipestill bottoms, vacuum pipestill streams including bottoms, gas oil condensates, heavy non-virgin hydrocarbon streams from refineries, vacuum gas oils, heavy gas oil, naphtha contaminated with crude, atmospheric residue, heavy residue, C4/residue admixture, naphtha/residue admixture, gas oil/residue admixture, and crude oil. The hydrocarbon feed can have a nominal final boiling point ≥315° C., ≥399° C., ≥454° C., or ≥510° C. Nominal final boiling point means the temperature at which 99.5 wt. % of a particular sample has reached its boiling point.

Optionally, e.g., when the hydrocarbon feed comprises certain Heavy Feedstocks, the steam cracking furnace has at least one vapor/liquid separation device (sometimes referred to as flash pot or flash drum) integrated therewith. When used, the vapor-liquid separator can be configured to upgrade the hydrocarbon feed (e.g., by upgrading the hydrocarbon+steam mixture and/or preheated hydrocarbon+steam mixture) upstream of the steam cracking furnace's radiant section. It can be desirable to integrate a vapor-liquid separator with the furnace when the hydrocarbon feed includes ≥1.0 wt. % of non-volatiles, e.g., ≥5.0 wt. %, such as about 5.0 wt. % to about 50.0 wt. % of non-volatiles having a nominal boiling point ≥760° C. It is particularly desirable to integrate a vapor/liquid separator with the pyrolysis furnace when the non-volatiles comprise asphaltenes, such as pyrolysis feedstock's hydrocarbon comprises ≥about 0.1 wt. % asphaltenes based on the weight of the pyrolysis feedstock's hydrocarbon component, e.g., ≥about 5.0 wt. %. Conventional vapor/liquid separation devices can be utilized to do this, though the invention is not limited thereto. Examples of such conventional vapor/liquid separation devices can include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705. A vapor phase can be separated from the hydrocarbon feed in the vapor/liquid separation device. The separated vapor phase can be conducted away from the vapor/liquid separator to the radian coils for pyrolysis. The liquid-phase separated from the hydrocarbon feed can be conducted away from the vapor/liquid separation device, e.g., for storage and/or further processing.

In other aspects, the hydrocarbon feed can comprise one or more relatively low molecular weight hydrocarbon (Light Feedstocks), particularly those aspects where relatively high yields of $C_2$ unsaturates (ethylene and acetylene). Light Feedstocks can include substantially saturated hydrocarbon molecules having fewer than five carbon atoms, e.g., ethane, propane, and mixtures thereof (e.g., ethane-propane mixtures or "E/P" mix). For ethane cracking, a concentration of at least 75% by weight of ethane is typical. For E/P mix, a concentration of at least 75% by weight of ethane plus propane is typical, the amount of ethane in the E/P mix being ≥20.0 wt. % based on the weight of the E/P mix, e.g., of about 25.0 wt. % to about 75.0 wt. %. The amount of propane in the E/P mix can be, e.g., ≥20.0 wt. %, based on the weight of the E/P mix, such as of about 25.0 wt. % to about 75.0 wt. %.

Steam Cracking Process Conditions

In certain aspects, the hydrocarbon+steam mixture can include steam in an amount in of about 10.0 wt. % to about 90.0 wt. %, based on the weight of the hydrocarbon+steam mixture, with the remainder of the hydrocarbon+steam mixture including or being the hydrocarbon feed. In certain aspects, the hydrocarbon+steam mixture can be produced by combining the preheated hydrocarbon exiting convection coil 13 with the preheated steam exiting convection coil 23, e.g., at a ratio of 0.1 to 1.0 kg steam per kg hydrocarbon, or a ratio of about 0.2 to about 0.6 kg steam per kg hydrocarbon.

Suitable steam cracking conditions can include, but are not limited to, exposing the hydrocarbon+steam mixture to a temperature (measured at the radiant outlet) of ≥400° C., e.g., from about 400° C. to about 900° C., from about 760° C. to about 1100° C., or from about 760° C. to about 880° C. Suitable steam cracking conditions can include, but are not limited to, exposing the hydrocarbon+steam mixture under a pressure of ≥0.1 bar (absolute), ≥1 bar (absolute), of about 0.1 to about 10 bar (absolute), or of about 1 to about 5 bar (absolute). Suitable steam cracking conditions can include, but are not limited to, exposing the hydrocarbon+steam mixture for a cracking residence time of about 0.01 to about 5.0 seconds or about 0.1 to about 2 seconds.

In certain aspects, the hydrocarbon feed can be or include Heavy Feedstock, and the hydrocarbon+steam mixture can include about 0.2 kg of steam to about 1 kg of steam per kg hydrocarbon. In these aspects, the steam cracking conditions can include one or more of (i) a temperature of about 760° C. to about 880° C.; (ii) a pressure of about 1 to 5 bar (absolute), or (iii) a cracking residence time of about 0.1 to 2 seconds. The effluent of radiant coil 40 typically has a temperature of about 760° C. to about 880° C., e.g., about 790° C.

In other aspects, the hydrocarbon feed can be or include Light Feedstock, and the hydrocarbon+steam mixture can comprise about 0.2 to 0.5 kg steam per kg hydrocarbon. In these aspects, the steam cracking conditions can include one or more of (i) a temperature of about 760° C. to about 1100° C.; (ii) a pressure of about 1.0 to about 5.0 bar (absolute), or (iii) a cracking residence of about 0.10 to about 2 seconds. The effluent of radiant coil 40 can have a temperature of about 760° C. to about 1100° C., e.g., about 900° C. for ethane or propane feeds.

After the desired degree of thermal cracking has been achieved in the radiant section 200, the furnace effluent can be rapidly cooled. For this purpose, quench oil can be injected into the pyrolysis effluent via at least one direct oil quench fitting located in a quenching stage (not shown). Additional quenching stages can be utilized in parallel, with a radiant coil (or group of radiant coils) providing a portion of a total pyrolysis effluent to each of the plurality of parallel quenching stages. For simplicity, pyrolysis effluent quenching can be described with respect to a single radiant coil 40 feeding a single quench zone, but the process is not limited to this aspect. The addition of quench oil into the furnace effluent stream can provide heat transfer from the pyrolysis effluent directly to the injected quench oil. The pyrolysis effluent can be cooled primarily by the vaporization of the injected quench oil.

Regardless of the hydrocarbon feed being cracked, carbonaceous deposits ("coke") can accumulate in one or more regions of the steam cracking furnace 1, e.g., in the radiant coils 40.

Coke can accumulate over time, and is a byproduct of hydrocarbon pyrolysis, its formation and accumulation is largely unavoidable. Besides the inner surfaces of the radiant coils, coke can accumulate in convection coils conveying hydrocarbon feed and/or hydrocarbon+steam mixture, in cross-over piping, and in the quenching zone, such as in one or more of direct oil-quench connections, fittings, and nozzles in the quenching zone.

When coke accumulates on the internal surfaces of the radiant coils, the accumulated coke can decrease the effective cross-sectional area of the tube, thereby necessitating higher pressures to maintain a constant throughput. Since coke is an effective insulator, its formation on tube walls can be accompanied by an increase in furnace tube temperature to maintain cracking efficiency. High operating temperatures, however, can result in a decrease in radiant coil lifetime, a decrease in yield of desired products (primarily as a result of less selective cracking which occurs at higher pressures), and an increase in coke accumulation rate. These effects lead to practical limits on the temperature to which a radiant coil can be exposed, and consequently reduce the flexibility to overcome the undesirable effects of coke accumulation by increasing radiant coil temperature. In practice, at the start of pyrolysis mode, when radiant coil internal surface has little or no accumulated coke, the radiant coil can exhibit a start-of-run temperature ("TSOR"). As coke accumulates, the radiant coil temperature can be increased (in response to increased firebox burners' caloric output) to a pre-determined end-of-run temperature ("TEOR"). Coke accumulation can be observed directly or indirectly, e.g., as indicated by a greater pressure drop across the radiant coil or a lower temperature of the radiant coil effluent (at a substantially constant caloric output of the firebox burners). Radiant coil temperature can be increased (e.g., by increasing steam cracker furnace burner duty, in other words firebox burner caloric output) until the radiant coil temperature is at or near TEOR, at which point the radiant coil, and optionally the hydrocarbon+steam conduits (or vessels) feeding the radiant coil, can be designated for decoking. The designated coils (and conduits/vessels) can be then switched from pyrolysis mode to decoking mode.

The process for decoking can include the step of reducing or terminating the flow of hydrocarbon feed to a portion of the plurality of coils in tube banks 102, 104, and 202, supplying a decoking feed to the portion of the plurality of coils in tube banks 102, 104, and 202 to effect removal of coke accumulated on the interior of the radiant coils or quench system components fed by such convection coils, and returning the portion of the plurality of coils in tube banks 102, 104, and 202 to hydrocarbon processing operation by returning the flow of hydrocarbon feed. By the use of the term "portion of the plurality of coils" is meant to refer to at least one and less than all of the plurality of coils.

In some examples, the decoking feed can have a pressure of ≥690 kPag, ≥930 kPag, ≥1200 kPag, ≥1380 kPag, ≥1725 kPag, ≥or 1930 kPag. In some examples, the decoking feed can have a pressure of 690 kPag to 4140 kPag, 690 kPag to 1930 kPag, 690 kPag to 1725 kPag, 930 kPag to 4140 kPag, 930 kPag to 1930 kPag, 930 kPag to 1725 kPag, 1725 kPag to 4140 kPag, 930 kPag to 1380 kPag, or 1380 kPag to 1725 kPag. In some examples, the decoking feed can be supplied from letdown high pressure steam (about 1725 kPag to about 4140 kPag), medium pressure steam (about 930 kPag to about 1380 kPag), medium-high pressure steam (about 1380 kPag to about 1725 kPag) or dilution steam recycled from the condensed water component of furnace effluent (effectively recycled steam) often called dilution steam. In some examples, the decoking feed can be supplied from a dilution steam line maintained at a pressure of ≥690 kPag, ≥930 kPag, ≥1200 kPag, or ≥1380 kPag. In some examples, the decoking feed can be supplied from a dilution steam line maintained at a pressure of 690 kPag to 4140 kPag, 690 kPag to 1930 kPag, 690 kPag to 1725 kPag, 930 kPag to 4140 kPag, 930 kPag to 1930 kPag, 930 kPag to 1725 kPag, 1725 kPag to 4140 kPag, 930 kPag to 1380 kPag, or 1380 kPag to 1725 kPag. In some examples, the decoking feed can be essentially free of added water. In some examples, the decoking feed can comprise ≤1 wt. %, ≤0.1 wt. %, or ≤0.01 wt. % of water when introduced into the first radiant coil. In some examples, the decoking feed can be or include steam.

The decoking process can include the step of reducing the flow of hydrocarbon feed into convection coil 13 by closing valve 12. In some examples, the flow of the hydrocarbon feed into the pyrolysis furnace is decreased by about 10 vol. % to about 90 vol. %, about 10 vol. % to about 40 vol. %, or about 10 vol. % to about 20 vol. %. Because the hydrocarbon feed can be introduced into multiple convection coils (not shown), on-stream decoking can occur when some of the closing valves (not shown) are left open to allow a portion of the hydrocarbon feed pass through to convection coils (not shown). Any number of the feed conduit 11 valves (not shown) can be in the open position to allow for the hydrocarbon feed to pass through into the convection coils in a first coil bank. In some examples, 1, 2, 3, 4, 5, 6, 7, 8, 9, 10, 11, 12, 13, 14, 15, 16, or 17 feed conduit valves (not shown) remain open. In some examples, at least 1, 2, 3, 4, 5, 6, 7, 8, 9, 10, 11, 12, 13, 14, 15, 16, or 17 feed conduit valves (not shown) remain open. In addition, any number of the feed conduit valves (not shown) can be closed to reduce the hydrocarbon feed into the convection coils (not shown) in the first coil bank. In some examples, 1, 2, 3, 4, 5, 6, 7, 8, 9, 10, 11, 12, 13, 14, 15, 16, or 17 feed conduit valves (not shown) are closed to reduce the flow of the hydrocarbon feed into the convection coils (not shown) in the first coil bank. In some examples, at least 1, 2, 3, 4, 5, 6, 7, 8, 9, 10, 11, 12, 13, 14, 15, 16, or 17 feed conduit valves (not shown) are closed to reduce the flow of the hydrocarbon feed into the convection coils (not shown) in the first coil bank. In some examples, when valve 12 or valves (not shown) are closed, the flow of the hydrocarbon is terminated.

The decoking feed can be introduced into convection coil 23 through valve 22 in the second collection bank 104 causing on-stream decoking when hydrocarbon feed is still being introduced into convention coils (not shown) in the first collection bank 102. In some examples, the decoking feed is provided from letdown steam or dilution steam recycled from the condensed water component of furnace effluent. In some examples, the decoking feed in conduit 20 can be from the same source as the steam utilized during pyrolysis mode. In some examples, the flow rate of the decoking steam can be from about 0.1 kg/sec to about 6 kg/sec. In some examples where the flow rate of the decoking feed has increased relative to the flow rate of the steam utilized during pyrolysis, the pressure can be increased to maintain the pressure within the desired range. The flow rate of the decoking Therefore cross-piping 31 and radiant coil 40 can have a reduced amount of hydrocarbon feed, e.g. no hydrocarbon feed, such that decoking can occur in cross-over piping 31, and radiant coil 40 while hydrocarbon conversion is still occurring in the radiant coils (not shown) that do not have a reduced amount of hydrocarbon feed. After the decoking step is completed, hydrocarbon conversion can resume by opening valve 12 to increase the flow of the hydrocarbon feed to cross-piping 31 and radiant coil 40. In some examples, this decoking process can occur in any tube having a reduced amount of hydrocarbon feed.

In some examples, the transition from pyrolysis to decoking can be ≤60 minutes, ≤45 minutes, ≤30 minutes, or ≤15 minutes. The transition from pyrolysis to decoking has occurred when (1) the hydrocarbon feed is stopped and the decoking feed has started, (2) the radiant coil outlet temperature ≥980° C., and (3) the average rate of change of the crossover temperature for one minute ≤10° C/hour. In some examples, 1, 2, 3, 4, 5, or 6 passes can transition from pyrolysis to decoking in be ≤60 minutes, ≤45 minutes, ≤30 minutes, or ≤15 minutes.

In some examples, the steam to hydrocarbon ratio used during pyrolysis can be ≤0.45, ≤0.40, ≤0.35, or ≤0.30. Although not being bound to any theory, Applicant believes that improved decoking can allow the pyrolysis mode to be operated under harsher conditions (high-coking-rate operations at higher conversion) such as a decreased steam to hydrocarbon ratio. Additional benefits of operating at high-coking-rate operations at higher conversion can include increased ethane conversions, reduced water consumption, reduced energy use, and increased annual production. In some examples, the ethane conversion during pyrolysis can be ≥70%, ≥75%, ≥78%, or ≥80%. In some examples, mechanical cleaning by hydroblasting can be avoided.

In some examples, the furnace temperature can remain constant or increase during decoking or during the transition from pyrolysis to decoking. Typically, a furnace temperature must be decreased during the transition from pyrolysis to decoking or during decoking for on-stream decoking.

During decoking, the temperature of the cross-over piping can be controlled using furnace firing rates or decoke steam rates. In some examples, a maximum crossover temperature of the pyrolysis furnace and a target temperature of the pyrolysis furnace can be compared to determine a maximum firing rate of the pyrolysis furnace to maintain a crossover temperature of the pyrolysis furnace at or below the target temperature of the pyrolysis furnace. In some examples, automated system can maintain the crossover temperature of the pyrolysis furnace at or below the target temperature of the pyrolysis furnace. In some examples, crossover temperature instrumentation and dynamic matrix controls can be automated systems used in this process. In some examples, automated system can maintain the crossover temperature of the pyrolysis furnace at or below the target temperature of the pyrolysis furnace by automatically increasing or decreasing the firing rate of the pyrolysis furnace to maintain the crossover temperature below the maximum crossover temperature.

In some examples, maximum crossover temperature of the pyrolysis furnace can be below about 700° C., about 788° C., about 800° C., or about 900° C.

EXAMPLES

The foregoing discussion can be further described with reference to the following non-limiting examples.

Example 1

Comparative

In this comparative example, a system as depicted in FIG. 1 is employed. Initially, the furnace is operated in pyrolysis mode. A hydrocarbon feedstock was conducted to convection section 100 via a plurality of feed conduits 10 at a rate of 2 kg/s. Steam was introduced into the furnace via a plurality of steam conduits 20 to produce a hydrocarbon+steam mixture, the hydrocarbon+steam mixture comprising 0.2 to 0.5 kg steam per kg hydrocarbon. The hydrocarbon+steam mixture was thermally cracked in radiant section 200 in a plurality of radiant coils 40, with the radiant coil effluent conducted to quenching stage via transfer line piping. The steam cracking conditions in the radiant coils included (i) a temperature in the range of 760° C. to 880° C.; (ii) a pressure in the range of from 1.0 to 5.0 bar (absolute), and (iii) a cracking residence time in the range of from 0.10 to 2.0 seconds. The effluent of radiant coils 40 had a temperature of about 790° C. (1450° F.). Quench oil was provided at a rate of 50 kg/s to quenching stage via a plurality of conduits, to cool the radiant coil effluent. Pyrolysis mode is continued until a radiant coil temperature of about 1080° C. (1975° F.) is needed to maintain the desired radiant coil effluent temperature of 790° C. The furnace was then switched to decoking mode.

Figure 2:
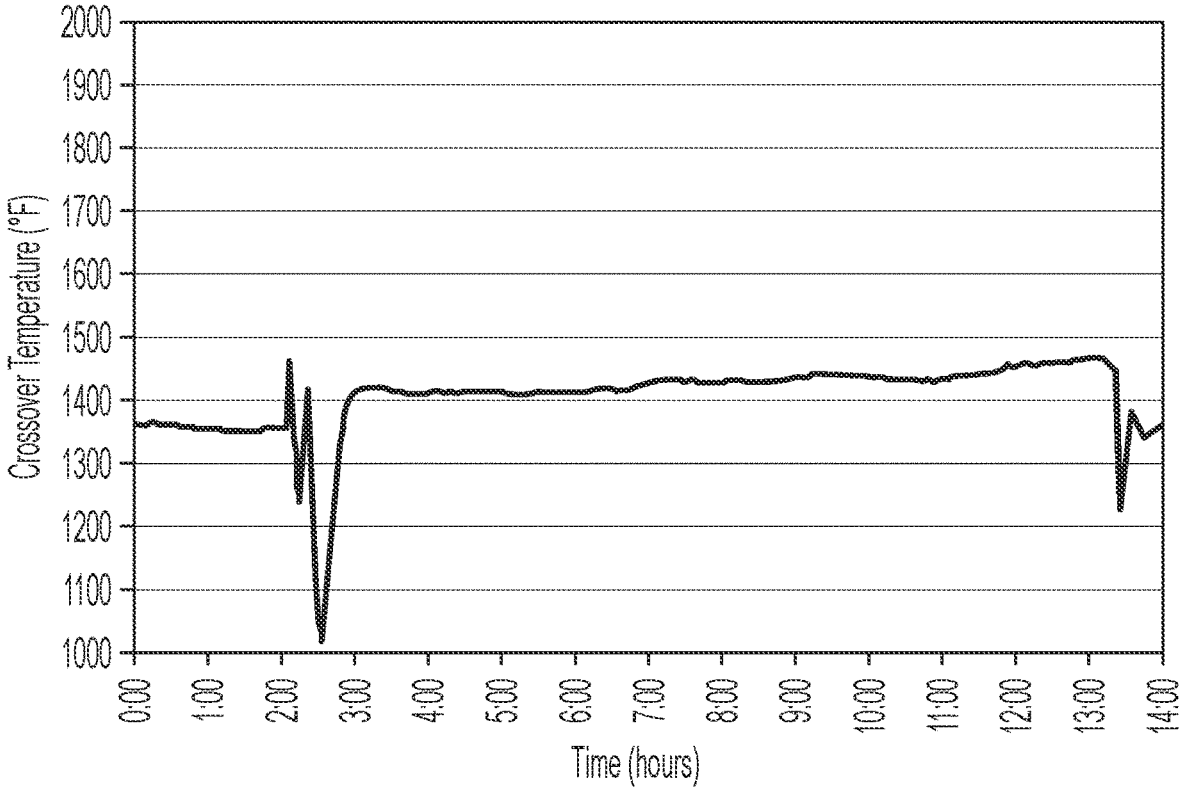
FIG. 2 is graph showing crossover temperature during a steam-water decoking from Example 1.

During decoking, heavy feedstock flow is stopped in some feed conduits. A flow of decoking steam was introduced into the convection section via some of the plurality of lines 20. The decoking steam was obtained from the same source as the steam utilized during pyrolysis mode. The total rate of water flow to the convection section via some of the inlet conduits 10 is about 1.25 kg/sec. The total flow of steam to the convection section via some of the plurality of lines 20 is about 1.25 kg/sec. The decoking water and the decoking steam were preheated in convection section 100 and combined to produce a decoking mixture. The decoking mixture was conveyed back to the convection section via the plurality of conduits. The decoking mixture flowed through some of the plurality of conduits in the convection and radiant sections to at least partially decoke those conduits. The caloric output of plurality of burners was lessened during decoking mode. Decoking effluent entering transfer line piping 53 was observed to have a temperature at the start of decoking mode of about 871° C. (about 1600° F.). As shown in FIG. 2, the water causes a temperature swing that results in the crossover temperature taking longer to stabilize. Temperature swings such as the one exemplified in FIG. 2 should be avoided as they can cause thermal fatigue in metals.

Example 2

Figure 3:
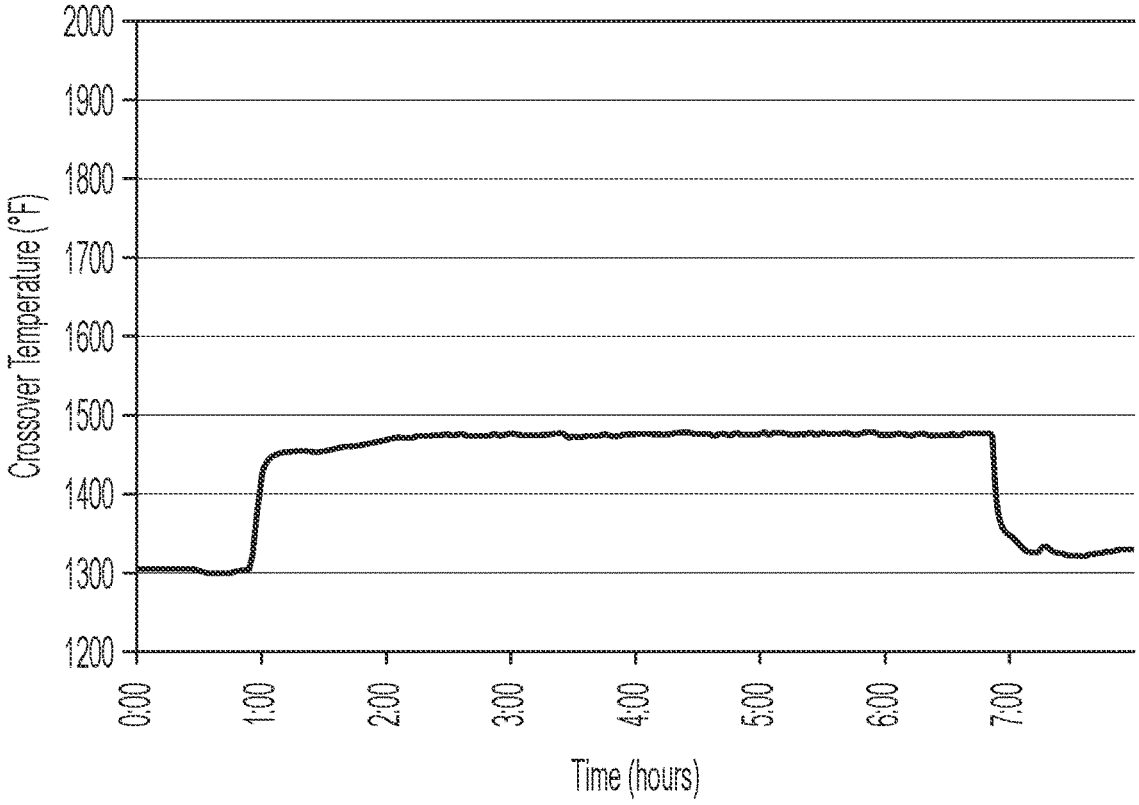
FIG. 3 is graph showing crossover temperature during a high-pressure steam decoking from Example 2.
Figure 4:
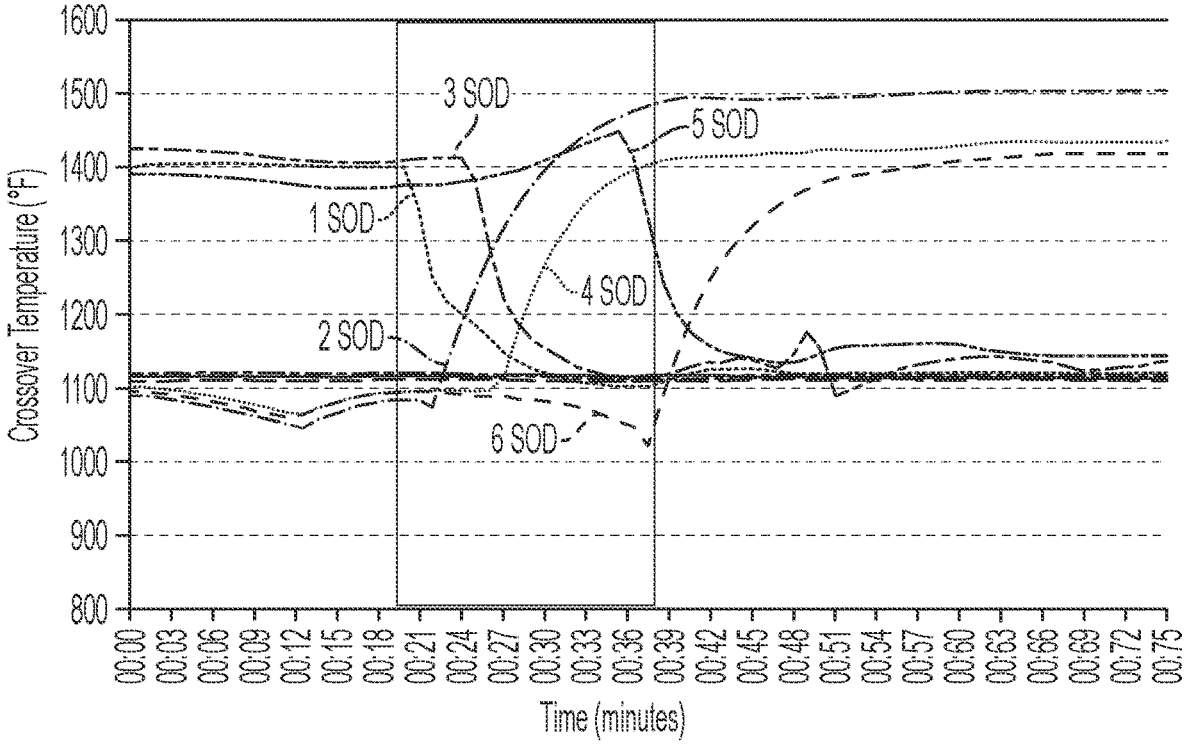
FIG. 4 is graph showing crossover temperature during a high-pressure steam decoking from Example 2.

Example 1 was repeated, except that during decoking, the feedstock flow was only stopped for some of the conduits and no water was introduced into the conduits where the feedstock is stopped. The decoking steam was obtained from the same source as the steam utilized during pyrolysis mode. The total flow of steam to the convection section via the plurality of lines 20 was about 2.5 kg/sec. No water was introduced into the quench system. FIG. 3 shows the crossover temperature during the online steam decoke and the smoother transition than the steam-water decoking from Example 1. The smoother transition results in a much quicker transition to decoking. For example, FIG. 4 shows six steam only decoke transitions in 17 minutes using higher pressure steam and no water added (three passes 1, 3, 5 are transitioning from decoking to pyrolysis and three passes 2, 4, 6 are transitioning from pyrolysis to decoking). A single transition to decoke using water can take significantly longer as shown in FIG. 2.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A hydrocarbon pyrolysis process, comprising:

introducing a flow of a hydrocarbon feed into a pyrolysis furnace comprising a first radiant coil and a second radiant coil to establish flows of the hydrocarbon feed into the first and second radiant coils;

pyrolysing at least a portion of the hydrocarbon feed in the first radiant coil and in the second radiant coil to produce a pyrolysis effluent and to deposit coke on an inner surface of each of the first radiant coil and the second radiant coil;

decreasing the flow of the hydrocarbon feed into the first radiant coil and maintaining the flow of the hydrocarbon feed into the second radiant coil, wherein the flow of the hydrocarbon feed into the pyrolysis furnace is decreased by about 10 vol. % to about 90 vol. %; and introducing a decoking feed comprising steam at a pressure of ≥690 kPag into the first radiant coil of the pyrolysis furnace to remove at least a portion of the coke deposited on the inner surface of the first radiant coil.

2. The process of claim 1, wherein the decoking feed comprises steam at a pressure of ≥930 kPag.

3. The process of claim 1, wherein the decoking feed comprises steam at a pressure of ≥1200 kPag.

4. The process of claim 1, wherein the decoking feed comprises steam at a pressure of ≥1380 kPag.

5. The process of claim 1, wherein the decoking feed comprises steam at a pressure of up to 4140 kPag.

6. The process of claim 1, further comprising comparing a maximum crossover temperature of the pyrolysis furnace and a target temperature of the pyrolysis furnace to determine a maximum firing rate of the pyrolysis furnace to maintain a crossover temperature of the pyrolysis furnace at or below the target temperature of the pyrolysis furnace.

7. The process of claim 6, further comprising utilizing an automated system to maintain the crossover temperature of the pyrolysis furnace at or below the target temperature of the pyrolysis furnace.

8. The process of claim 1, wherein the decoking feed introduced into the first radiant coil comprises ≤1 wt. % of water.

9. The process of claim 1, wherein the decoking feed consists essentially of steam.

10. The process of claim 1, further comprising increasing the flow of the hydrocarbon feed into the first radiant coil after the portion of the coke deposited on the inner surface of the first radiant coil has been removed.

11. The process of claim 1, wherein the step of decreasing the flow of the hydrocarbon feed into the first radiant coil comprises terminating the flow of the hydrocarbon feed into the first radiant coil.

12. The process of claim 1, wherein the transition from pyrolysis to decoking is ≤60 minutes.

13. The process of claim 1, wherein the transition from pyrolysis to decoking is ≤45 minutes.

14. The process of claim 1, wherein the transition from pyrolysis to decoking is ≤30 minutes.

15. The process of claim 1, wherein the transition from pyrolysis to decoking is ≤15 minutes.

16. A hydrocarbon pyrolysis process, comprising:

introducing a flow of a hydrocarbon feed into a pyrolysis furnace comprising a first radiant coil and a second radiant coil to establish flows of the hydrocarbon feed into the first and second radiant coils;

pyrolysing at least a portion of the hydrocarbon feed in the first radiant coil and the second radiant coil to produce a pyrolysis effluent and to deposit coke on an inner surface of each of the first radiant coil and the second radiant coil;

decreasing the flow of the hydrocarbon feed into the first radiant coil and maintaining the flow of the hydrocarbon feed into the second radiant coil wherein the flow of the hydrocarbon feed into the pyrolysis furnace is decreased 10 vol. % to 90 vol. %.;

introducing a decoking feed comprising steam at a pressure of ≥930 kPag into the first radiant coil of the pyrolysis furnace to remove at least a portion of the coke deposited on the inner surface of the first radiant coil; and adjusting a firing rate of the pyrolysis furnace to maintain a crossover temperature of the pyrolysis furnace at or below a target temperature of the pyrolysis furnace.

17. The process of claim 16, wherein an automated system is utilized to adjust the firing rate of the pyrolysis furnace.

18. The process of claim 17, wherein the automated system comprises a dynamic matrix control.

19. The process of claim 16, wherein (i) the firing rate of the pyrolysis furnace and (ii) the amount of the decoking feed introduced into the first radiant coil are both adjusted to optimize a composition of the pyrolysis effluent.

20. The process of claim 16, wherein the decoking feed is supplied from a dilution steam line maintained at a pressure of ≥930 kPag.

21. The process of claim 16, wherein the decoking feed comprises steam at a pressure of ≥1200 kPag.

22. The process of claim 16, wherein the decoking feed comprises steam at a pressure of ≥1380 kPag.

23. The process of claim 16, wherein the decoking feed is supplied from a dilution steam line maintained at a pressure of ≥1380 kPag.

24. The process of claim 16, wherein the decoking feed introduced into the first radiant coil comprises ≤1 wt. % of water.

25. The process of claim 16, wherein the decoking feed consists essentially of steam.

26. The process of claim 16, further comprising increasing the flow of the hydrocarbon feed into the first radiant coil after the portion of the coke deposited on the inner surface of the first radiant coil has been removed.

27. The process of claim 16, wherein the step of decreasing the flow of the hydrocarbon feed into the first radiant coil comprises terminating the flow of the hydrocarbon feed into the first radiant coil.

28. The process of claim 16, wherein the transition from pyrolysis to decoking is ≤15 minutes.

29. A hydrocarbon pyrolysis process, comprising:

introducing a flow of a hydrocarbon feed into at least one radiant coil of a pyrolysis furnace;

pyrolysing at least a portion of the hydrocarbon feed in the at least one radiant coil to produce a pyrolysis effluent and to deposit coke on an inner surface of the at least one radiant coil;

decreasing the flow of the hydrocarbon feed into the at least one radiant coil; and introducing a flow of a decoking teed comprising steam at a pressure of >690 kPag into the at least one radiant coil of the pyrolysis furnace to remove at least a portion of the coke deposited on the inner surface of the at least one radiant coil.

30. The process of claim 29, wherein the decoking feed comprises steam at a pressure of ≥930 kPag.

31. The process of claim 29, wherein the decoking feed consists essentially of steam.

* * * * *